US006428624B1

(12) United States Patent
Coleman, III et al.

(10) Patent No.: US 6,428,624 B1
(45) Date of Patent: Aug. 6, 2002

(54) METHOD OF PROVIDING FLAVORFUL AND AROMATIC COMPOUNDS

(75) Inventors: William Monroe Coleman, III; Michael Francis Dube; Luis Mayan Dominguez, all of Winston-Salem, NC (US)

(73) Assignee: R. J. Reynolds Tobacco Co., Winston-Salem, NC (US)

( * ) Notice: Subject to any disclaimer, the term of this patent is extended or adjusted under 35 U.S.C. 154(b) by 0 days.

(21) Appl. No.: 09/909,384

(22) Filed: Jul. 19, 2001

Related U.S. Application Data

(63) Continuation of application No. 09/206,475, filed on Dec. 7, 1998, now abandoned.

(51) Int. Cl.[7] ..... A24B 15/30; A24B 15/00; A24F 15/00

(52) U.S. Cl. ..... 131/276; 131/274; 131/277; 131/278; 428/905; 206/242

(58) Field of Search ..... 131/274, 276, 131/277, 278; 428/905; 206/242

(56) References Cited

U.S. PATENT DOCUMENTS

| | | | |
|---|---|---|---|
| 3,478,015 | A | 11/1969 | Onishi et al. |
| 3,722,516 | A | 3/1973 | Suwa et al. |
| 3,920,026 | A | 11/1975 | Warfield et al. |
| 4,306,577 | A | 12/1981 | Wu et al. |
| 4,379,464 | A | 4/1983 | Wu et al. |
| 4,407,307 | A | 10/1983 | Gaisch et al. |
| 4,537,204 | A | 8/1985 | Garisch et al. |
| RE32,095 | E | 3/1986 | Wu et al. |
| 5,246,017 | A | 9/1993 | Saintsing et al. |
| 5,413,122 | A | 5/1995 | Shu et al. |

OTHER PUBLICATIONS

Factors Affecting the Formation of Pyrazine Compounds in Sugar–Amine Reactions, P. Koehler et al.; J. Agr. Food Chem., vol. 18, No. 5, 1970, pp. 895–898.

Formation of Pyrazine Compounds in Sugar–Amino Acid Model Systems, P. Koehler, J. Agr. Food Chem., vol. 17, No. 2, Mar.–Apr. 1969, pp. 393–396.

*Primary Examiner*—James Derrington
*Assistant Examiner*—Dionne A. Walls

(57) ABSTRACT

A method for providing flavorful and aromatic substances for use in a smoking article is disclosed. In the method, a mixture is provided including a reducing sugar source and a base catalyst. The mixture has a selectively enriched content of at least one free amino acid selected from the group consisting of serine, threonine, valine, leucine, and isoleucine. The mixture is then subjected to heat treatment for a time and under conditions sufficient to provide a flavorful and aromatic composition

30 Claims, 1 Drawing Sheet

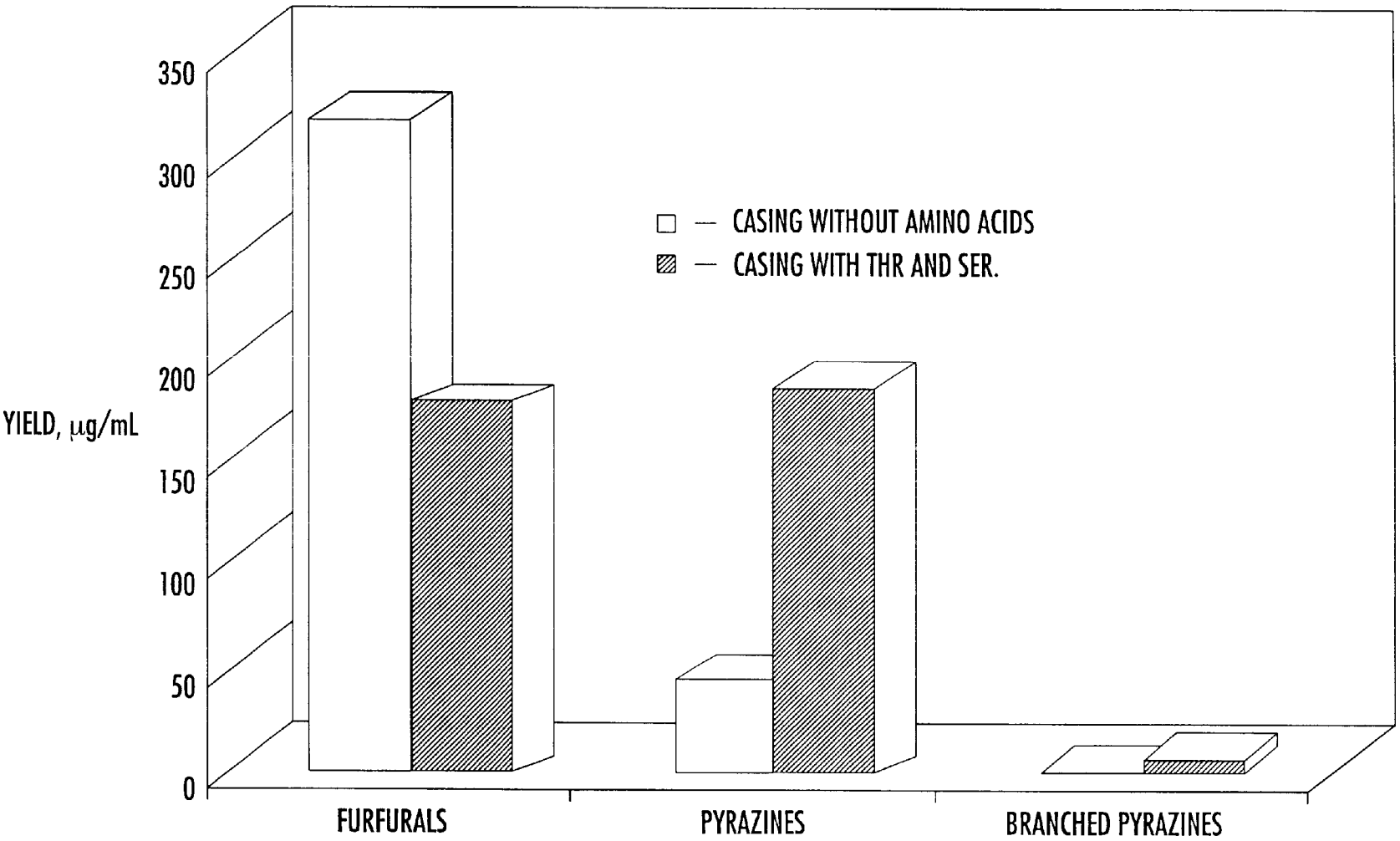
CASING WITHOUT AMINO ACIDS
CASING WITH THR AND SER.
YIELD, µg/mL
350
300
250
200
150
100
50
0
FURFURALS
PYRAZINES
BRANCHED PYRAZINES

METHOD OF PROVIDING FLAVORFUL AND AROMATIC COMPOUNDS

CROSS-REFERENCE TO RELATED APPLICATIONS

This application is a continuation of U.S. application Ser. No. 09/206,475, filed Dec. 7, 1998, now abandoned which is hereby incorporated by reference herein in its entirety.

FIELD OF INVENTION

The present invention relates to smoking articles such as cigarettes, and in particular to process for providing a flavorful and aromatic composition similar to those characteristics of certain tobaccos.

BACKGROUND OF THE INVENTION

Popular smoking articles, such as cigarettes, have a substantially rod shaped structure and include a charge of smokable material such as strands or shreds of tobacco (e.g., cut filler) surrounded by a paper wrapper thereby providing a so-called "tobacco rod." Numerous popular cigarettes have cylindrical filter elements aligned in an end-to-end relationship with the tobacco rod. Typically, filter elements are constructed from fibrous materials such as cellulose acetate, have a circumscribing plug wrap, and are attached to the tobacco rod using tipping material.

Many types of smoking products and improved smoking articles have been proposed through the years as improvements upon, or as alternatives to, the popular smoking articles. Recently, U.S. Pat. No. 4,708,151 to Shelar; U.S. Pat. No. 4,714,082 to Banerjee et al.; U.S. Pat. No. 4,756,318 to Clearman et al.; and U.S. Pat. No. 4,793,365 to Sensabaugh, Jr. et al.; and European Patent Publication Nos. 212,234 and 277,519 propose cigarettes and pipes which comprise a fuel element, an aerosol generating means physically separate from the fuel element, and a separate mouthend piece. Such types of smoking articles provide natural tobacco flavors to the smoker thereof by heating, rather than burning, tobacco in various forms.

Flavor and aroma are important characteristics of smoking articles. To improve the flavor and aroma in smoking articles, flavorful and aromatic substances, including various natural extracts, have been included in smoking articles. For example, various processes for producing and using tobacco extracts, aroma oils and concentrates are proposed in the U.S. Pat. No. 3,136,321 to Davis; U.S. Pat. No. 3,316,919 to Green; U.S. Pat. No. 3,424,171 to Rooker; U.S. Pat. No. 4,421,126 to Gellatly and U.S. Pat. No. 4,506,682 to Mueller and European Patent Publication No. 338,831 to Clapp et al.

U.S. Pat. No. 5,413,122 to Shu issued on May 9, 1995 discloses making a flavorful and aromatic composition from β-hydroxy α-amino acids by contacting the amino acids with a liquid having an aqueous character followed by heat treatment in an enclosed environment to provide an aqueous solution of volatile pyrazine flavorants. The ratio of liquid to amino acid is 4:1 to 40:1. The resulting aqueous extract containing flavorful pyrazines is then applied to smoking materials to provide flavor and aroma in the smoking articles.

It has also been proposed to react sugars with amino acids to produce desirable flavorants for smoking articles and foods. For example, U.S. Pat. No. 3,478,015 discloses heating an amino acid and a sugar in the presence of a polyhydric alcohol and using the reaction product as a flavoring material.

U.S. Pat. No. 3,920,026 describes reacting the amino acid valine with a sugar, other hydroxycarbonyl compound, or dicarbonyl compound under heat treatment in a solvent such as glycerol or propylene glycol and at a temperature of about 100° C. to about 200° C. for about 0.5 to 5 hours. Optionally, a catalyst such as a flavanoid or hydroxyacid is included in the reaction. The reaction products can be used as flavorants in tobacco compositions.

U.S. Pat. No. 4,306,577 discloses the production of flavorants for smoking compositions by reacting reducing sugars and selected amino acids in the presence of ammonium hydroxide and optionally in the presence of an aldehyde in an essentially solvent-free system at a temperature range of 90° C. to 115° C. The selected amino acids are those that have at least two nitrogens such as glutamine, asparagine, lysine, and arginine.

Similarly, U.S. Pat. No. Re. 32,095 discloses reacting a reducing sugar with a source of ammonia in the presence of a trace amount of certain amino acids at a temperature in the range of about 90° C. to about 115° C. for about 5 to 15 minutes. The trace amino acids include aspartic acid, glutamic acid, asparagine, and glutamine. The weight ratio of sugar to amino acid is in the range of 200–300:1, and the weight ratio of sugar to ammonia source is about 5–15:1.

Because of the volatile nature of flavorant and aroma materials, they are often lost during use in cigarette manufacturing steps. Also quantities of the flavorant and aroma materials can diminish during the storage of the finished smoking articles and it is often necessary to increase the initial content of flavorants to compensate.

SUMMARY OF THE INVENTION

In accordance with the present invention, highly desirable flavorful and aromatic substances, and particularly flavorful and aromatic substances similar to and complementing those found in smokable materials are generated by heating a mixture comprising a reducing sugar source, a base catalyst, and an amino acid source material having a selectively enriched content of at least one amino acid selected from the group consisting of serine, threonine, valine, leucine, and isolecine. The resulting composition of flavorful and aromatic substances from the reaction includes a substantial quantity of flavorful and aromatic pyrazines that have low volatility and a low sensory threshold, i.e., powerful sensory attributes at very low concentrations. Examples of such pyrazines include, but are not limited to, methylcyclopentapyrazine, cyclopentapyrazine, 2-methyl-5,6,7,8-tetrahydroquinoxaline, dimethyl-isopropenyl pyrazine, dimethyl-propenyl pyrazine, methyl-propenyl pyrazine, acetylpyrazine, 2,3,5-trimethyl-6-ethylpyrazine, 2-methyl-3,5-dimethyl pyrazine, 2,6-diethyl pyrazine, trimethyl pyrazine, dimethyl pyrazine, etc. These pyrazines are characterized by larger side chains than flavorant pyrazines normally added to tobacco and/or generated in substantial quantities during smoking. The larger side chains have dual effects of decreasing the volatility of the flavorant while at the same time increasing the flavor potency of the flavorant substances typically by many orders of magnitude. Thus, less quantities of the flavorant and aroma materials can be used in smoking articles to provide a significantly greater enhancement of flavor and aroma. At the same time, loss of the flavorants during manufacturing and storage of the smoking articles is minimal.

Accordingly, in a first aspect, the present invention relates to a method for providing flavorful and aromatic substances for use in a smoking article. A mixture is provided comprising a reducing sugar source, a base catalyst, and an amino acid source having a selectively enriched content of at least one amino acid selected from the group consisting of serine, threonine, valine, leucine, and isoleucine. The mixture is then subjected to heat treatment for a time and under conditions sufficient to provide flavorful and aromatic substances.

The amino acid source can be a natural material containing endogenous free amino acids, or a composition comprising extracted or synthetic amino acids. The selective enrichment is the result of the incorporation of one or more exogenous free amino acids selected from the group consisting of serine, threonine, valine, leucine, and isoleucine in the amino acid source. Preferably, the mixture contains from about 0.1 to about 20%, more preferably from about 0.5% to about 10%, and most preferably from about 3% to about 5% by weight, e.g., 4% by weight, cumulatively, of amino acids selected from the group consisting of serine, threonine, valine, leucine, and isoleucine based on the total weight of the mixture.

Preferably, the mixture comprises materials normally used in casing, such as licorice and cocoa that contain endogenous free amino acids. More preferably, the mixture is formed by adding at least one desirable amino acid and at least one base catalyst to a conventional casing.

The mixture of reducing sugar source material, base catalyst and the amino acid source having a selectively enriched content of serine, threonine, leucine, and/or isoleucine is subjected to heat treatment at a temperature of at least about 175° F. to provide a reaction material. Normally, the mixture is exposed to a temperature sufficiently high and for a period of time sufficiently long so as to provide a reaction material which exhibits a pleasant flavor and aroma. However, it is preferable that the reaction material is not exposed to such a high temperature for a sufficiently long period of time so as to provide a reaction material which exhibits a burnt, tarry, overly bitter or highly metallic flavor.

In a preferred embodiment, the mixture is subjected to heat treatment in an enclosed system under pressure. A pressure controlled environment is provided by a pressure chamber or vessel which provides, during heat treatment, containment of the components of the mixture such that the lighter active compounds formed (e.g., ammonia, acetaldehyde, carbonyls, etc.) are retained within the vessel or chamber and can react to generate the flavorful and aromatic substances. Heat treatment is preferably conducted at a typical pressure range of from about 10 psig to about 1,000 psig, normally from about 20 psig to about 500 psig.

The resulting flavorful and aromatic substances includes pyrazine and pyridine components, having relatively low volatility and potent flavors. The flavorful and aromatic substances are useful as casing or top dressing components for tobacco laminae and cut filler, as well as for other smokable materials. Alternatively, such flavorful and aromatic substances are useful in those types of smoking articles described in U.S. Pat. No. 4,708,151 to Shelar; U.S. Pat. No. 4,714,082 to Banerjee et al.; U.S. Pat. No. 4,756,318 to Clearman et al.; and U.S. Pat. No. 4,793,365 to Sensabaugh et al.; as well as European Patent Publication Nos. 212,234 and 277,519.

The flavorful and aromatic compositions also are useful as cigarette filter additives. For example, the flavorful and aromatic compositions can be incorporated into low-density polyethylene and formed into strands, and then incorporated into cigarette filters as described in U.S. Pat. No. 4,281,671 to Bynre et al. and U.S. Pat. No. 4,826,905 to Green, Jr. et al. The flavorful and aromatic compositions also are useful as cigarette wrapper additives; or as additives to the inner regions of cigarette packages (e.g., within a paper/foil laminate of cigarette package or within a low density polyethylene film which is placed within a cigarette package) in order to provide a desirable cigarette aroma and "pack aroma."

Because the aromatic flavorants generated in the method of this invention have relatively low volatility, the loss of flavorants and aroma materials during the manufacturing process and storage of smoking articles is reduced. In addition, the aromatic flavorants have a dramatically high flavor potency, i.e., powerful sensory attributes at very low concentrations. As a result, smoking articles with improved flavor and aroma can be made with the aromatic flavorants. Further, the smoking articles can have more consistent and uniform flavorful and aromatic characters.

The foregoing and other advantages and features of the invention, and the manner in which the same are accomplished, will become more readily apparent upon consideration of the following detailed description of the invention taken in conjunction with the accompanying examples, which illustrate preferred and exemplary embodiments.

BRIEF DESCRIPTION OF THE FIGURES

The FIGURE demonstrates the yield of pyrazines and furfurals after heat treatment of a mixture according to the present invention having a selectively enriched content of threonine and leucine. This result is compared to the yield of pyrazines and furfurals after heat treatment of a mixture which does not have a selectively enriched content of any amino acids.

DETAILED DESCRIPTION OF THE INVENTION

Suitable reducing sugars for use in the mixture include, but are not limited to, glucose, fructose, mannose, galactose, rhamnose, and mixtures thereof. The reducing sugar can be in a pure form or in a crude form, e.g., high fructose corn syrup which contains about 40% or more of fructose. Reducing sugars can also be made by hydrolysis of disaccharides or polysaccharides as is well known in the art.

Base catalysts as used in the present invention are preferably ammonium compounds. Examples of such ammonium compounds include but are not limited to ammonium hydroxide and ammonium salts such as ammonium orthophosphate, ammonium dihydrogen orthophosphate, diammonium monohydrogen orthophosphate, ammonium citrate, ammonium acetate, ammonium carbonate and the like. Preferably, ammonium hydroxide or ammonium carbonate are employed when flavorants having elevated levels of pyrazine products are desired. Diammonium phophosphate (DAP) is preferred when flavorants having elevated levels of sugar thermal degradation products are desired.

In preferred embodiments of this invention, the mixture also contains natural biological materials or extracts of biological materials, for example, cocoa, licorice, and the like. Typically, suitable natural biological materials or extracts of biological materials are those biological materials that are usually included in casing. As is well known in the art, casing materials are used as additives to enhance the flavors in smokable materials. In cigarette manufacturing processes, casing materials are added to tobacco leaf blends before cutting. Exemplary casing ingredients that are commonly used in the art include, e.g., sugar, humectant such as glycerine or a higher glycol, licorice, cocoa, etc. In a preferred embodiment, the mixture is formed by adding a base catalyst to a conventional casing, and then selectively enriching the mixture with exogenous desirable amino acids as described in detail below.

As is apparent to the skilled artisan, some of the above-described materials may contain free amino acids. The term "free amino acids" used herein refers to amino acids that are not chemically modified and are not chemically bonded within proteins or peptides or other molecules. Typically, many natural biological materials or extracts of biological materials, such as licorice and cocoa, may contain natural free amino acids. As is known in the art, there are about twenty different types of free amino acids existing in biological materials. The free amino acids naturally existing in natural biological materials or extracts of biological materials used in the mixture are referred to herein as "endogenous" amino acids. The endogenous content of each amino acid and the total endogenous content of all free amino acids in different materials can be determined by various analytical methods known in the art.

The mixture to be heated in this invention has a selectively enriched content of at least one amino acid selected from the group consisting of serine, threonine, valine, leucine, and isoleucine. Preferably leucine and/or threonine is selectively enriched. More preferably, leucine and threonine are both selectively enriched.

The term "selectively enriched content" used herein means that the content, i.e. quantity, of the above-described amino acids, i.e., serine, threonine, valine, leucine, and isoleucine, in the mixture of this invention is higher than the total endogenous content of the same amino acids in the components of the mixture that naturally contain free amino acids, e.g., natural biological materials or extracts of biological. The term also means that the enrichment of these amino acids are "selective," i.e., the relative increase of the cumulative content by weight of these desirable free amino acids in the mixture is greater than the relative increase in the total cumulative content by weight of the remaining free amino acids naturally present in the components of the mixture that naturally contain free amino acids, e.g., natural biological materials or extracts of biological materials. Preferably, the relative increase of the cumulative content by weight of the amino acids serine, threonine, valine, leucine, and/or isoleucine in the mixture is at least 10% greater than the relative-increase in the total cumulative content by weight of the remaining free amino acids naturally present in the components of the mixture that naturally contain free amino acids, e.g., natural biological materials or extracts of biological materials.

The selective enrichment can be achieved by adding in the mixture "exogenous" desirable free amino acids, i.e., by providing the above-described at least one amino acid selected from the group consisting of serine, threonine, valine, leucine, and isoleucine in the mixture in addition to the endogenous serine, threonine, valine, leucine, and isoleucine in the components of the mixture that naturally contain free amino acids, e.g., natural biological materials or extracts of biological materials. Preferably, exogenous amino acids are incorporated in their substantially pure forms such as solid or solution. The exogenous amino acids may also be premixed with one of the other components prior to incorporation in the mixture. Preferably, only the content of the desirable amino acids, i.e., serine, threonine valine, leucine, isoleucine, or mixture thereof is increased although the content of the other free amino acids can also be increased somewhat if desired.

When the mixture does not contain any component that naturally have free amino acid, e.g., natural biological materials or extracts of biological materials such as licorice or cocoa, i.e., the mixture contains no endogenous free amino acids, any addition of exogenous desirable amino acids, i.e., serine, threonine, valine, leucine, and/or isoleucine to the mixture at a chemically detectable amount is considered herein to be selectively enrichment.

The total amount of all exogenous desirable amino acids, i.e., serine, threonine, valine, leucine, isoleucine, in the mixture can vary. Preferably, the mixture contains from about 0.1% to about 20%, more preferably from about 0.5% to about 10%, and even more preferably from about 3% to about 5% by weight, most preferably about 4% cumulatively, by weight, of exogenous amino acids selected from the group consisting of serine, threonine, valine, leucine, and isoleucine, based on the total weight of the mixture.

In the mixture, the content of the reducing sugar can be from about 5% to about 50%, preferably from about 10% to about 45%, and more preferably from about 30% to about 40% by weight of the total weight of the mixture. The molar ratio between the base catalyst and the reducing sugar in the mixture may range from about 0.01 to about 2.0, preferably from about 0.1 to about 1.0, more preferably about 0.4 to 0.6, and most preferably is about 0.5 mole base catalyst per mole of sugar. When licorice and cocoa are used, their cumulative content may be up to about 30%, preferably from about 2% to about 20%, and more preferably from about 5% to about 10%.

The mixture can be in either a solid or liquid state. Preferably, the mixture is dissolved in a liquid having an aqueous character to form a solution prior to heat treatment. Such a liquid consists primarily of water, normally greater than about 90 weight percent water, and can be essentially pure water in certain circumstances. For example, a solvent having an aqueous character can be distilled water, tap water, or the like. Preferably a 0.5:1 to 40:1 ratio of liquid to mixture is utilized in forming the solution. When the mixture is dissolved in an aqueous solution, pH optimization is optionally performed. Preferably, the pH of the solution is adjusted to from about 5 to about 10, more preferably to from about 6 to about 8, and most preferably to 7. Methods of adjusting pH should be apparent to a skilled artisan.

The mixture, or solution thereof, comprising reducing sugar, base catalyst and amino acid source which has a selectively enriched content of serine, threonine valine, leucine and/or isoleucine, is subjected to moderately high temperature treatment. Typically, such treatment involves exposing the mixture to a temperature above about 175° F., preferably above about 200° F., and more preferably above about 280° F. However, it is desirable to subject the amino acid to a temperature below about 450° F., more desirably below about 400° F., most preferably about 350° F. or less, in order to avoid an undesirable formation of components which are deleterious to the taste characteristics of the flavorful and aromatic composition. Most preferably the heat treatment is conducted at a temperature of from about 280° F. to about 350° F.

The moderately high temperature treatment of the mixture can be performed under an inert atmosphere. For example, nitrogen and argon gas can be employed in order to provide an inert atmosphere. However, the heat treatment can be conducted under ambient atmosphere (i.e., air).

The moderately high temperature treatment is preferably performed in a pressure-controlled environment. Such an environment is provided by enclosing the mixture in an air sealed vessel or chamber. Typically, a pressure-controlled environment is provided using a pressure vessel or chamber which is capable of withstanding relatively high pressures. Such vessels or chambers provide enclosure or concealment of the mixture such that any volatile flavor components generated are not lost or do not otherwise escape during the moderately high temperature treatment step. Preferred pressure vessels are equipped with an external heating source. Examples of vessels which provide a pressure controlled environment include a high pressure autoclave from Berghof/America Inc. of Concord, Calif. and a Parr Reactor Model No. 4522 and a Parr Reactor Model No. 4552 available from The Parr Instrument Co. Operation of such exemplary vessels will be apparent to the skilled artisan. Typical pressures experienced by the mixture during the process of the present invention range from about 10 psig to about 1,000 psig, normally from about 20 psig to about 500 psig. Pressures experienced by the mixture typically exceed 100 psig during the process of the present invention.

The amount of time that the mixture is subjected to the moderately high temperature treatment can vary. Normally, the time period is sufficient to heat the mixture at the desired temperature for a period of at least about 10 minutes, preferably at least about 20 minutes, more preferably at least about 30 minutes. Normally, the time period is less than about 3 hours, preferably less than about 1 hour. However, it is desirable to control the time/temperature profile of the mixture subjected to heat treatment so that the mixture is not subjected to a particularly high temperature for a lengthy period of time. It is highly desirable to employ a pressure vessel design or a vessel equipped with an agitation mechanism such that the mixture experiences a relatively uniform temperature throughout the treatment period. In particular, it is highly desirable for the mixture to be heated uniformly throughout as much as possible at the maximum temperature to which the mixture is subjected.

The heat treatment of the mixture in the present invention leads to the formation of highly desirable flavorful and aromatic substances, and particularly flavorful and aromatic substances similar to and complementing those found in smokable materials. The resulting composition of flavorful and aromatic substances from the reaction has a great proportion of pyrazines with large side chains. These pyrazines have low volatility and low sensory threshold, i.e., having powerful sensory attributes at very low concentrations. Examples of such pyrazines include, but are not limited to, methylcyclopentapyrazine, cyclopentapyrazine, 2-methyl-5,6,7,8-tetrahydroquinoxaline, dimethylisopropenyl pyrazine, dimethyl-propenyl pyrazine, methylpropenyl pyrazine, acetylpyridine, 2,3,5-trimethyl-6-ethylpyrazine, 2-methyl-3,5-dimethyl pyrazine, diethylpyrazines, trimethylpyrazines, dimethylpyrazines, etc.

The flavorful and aromatic composition thus generated is particularly rich in pyrazines having 3 or more carbons in their side chains. As shown in Table I, generally speaking, the more complex side chains a pyrazine has, the higher odor strength and the lower volatility the pyrazine exhibits. Therefore, the increased content of pyrazines having larger side chains significantly decreases the volatility and increases the flavor potency of the flavorant substances. Thus, when the flavorant and aroma materials are used in smoking articles, less quantities are required and they do not diminish significantly during manufacturing and storage of the smoking articles.

TABLE I

| Pryazine | No. of Carbons | Odor Strength | Volatility, bp ° C. |
|---|---|---|---|
| 2-Methyl- | 1 | 1 | 136 |
| 2-Ethyl- | 2 | 10 | 150 |
| 2,3-Dimethyl- | 2 | 24 | |
| 2,5-Dimethyl- | 2 | 33 | 155 |
| 2,6-Dimethyl- | 2 | 60 | 154 |
| 2,3,5-Trimethyl- | 3 | 150 | 171 |
| 2-Methyl-3-ethyl- | 3 | 460 | |
| 2-Methyl-5-ethyl- | 3 | 600 | |
| 2-Methyl-6-ethyl- | 3 | 1200 | |
| 2,3,5,6-Tetramethyl- | 4 | 150 | 190 |
| 2,3-Diethyl- | 4 | 240 | |
| 2,5-Dimethyl- | 4 | 3000 | |
| 2,6-Dimethyl- | 4 | 10,000 | |
| 2-Ethyl-3,5-dimethyl- | 4 | 60,000 | |
| 2-Ethyl-3,6-dimethyl- | 4 | 120,000 | |

The flavorful and aromatic composition can be used with various components of smoking articles. The amount of flavorful and aromatic composition employed per cigarette can vary. For example, in a typical cigarette having about 0.6 to about 1 g/rod of smoking material, about 10 to about $10^5$ ppm of the composition can be used as top dressing or casing. Generally up to 5% of the composition by dry weight, based on the dry weight of tobacco materials, can be used in the cigarette.

Cigarettes can further include a filter element such as positioned adjacent to one end of rod such that the filter element is axially aligned with the rod in an end-to-end relation. Filter elements have a substantially cylindrical shape, and the diameter of the rod is substantially equal to the diameter of the filter element. Preferably, the filter element abuts the rod. The ends of the filter element are open to permit the passage of air and smoke therethrough. The filter element comprises filter material which optionally is overwrapped with circumscribing wrap material. The filter material can be in intimate contact with the flavorful and aromatic composition. Such a segment is referred to as a "smoke-altering filter segment." Normally, prior to smoking the cigarette, the smoke-altering filter segment includes at least about 0.1 percent of the mixture, based on the weight of the filter material. The filter material can be a conventional cigarette filter material such as cellulose acetate, polypropylene, or the like, and the filter element can have a fibrous character, a molded shape, or other such configuration.

The composition can also be contacted with tobacco and employed as a form of tobacco in smoking article manufacture. For example, tobacco cut filler, as well as the types of smokable materials described in commonly assigned U.S. Pat. No. 4,920,990 to Lawrence et al., the disclosure of which is incorporated herein by reference, can be coated or otherwise contacted with about 0.001 to about 5 percent by weight of the flavorful and aromatic composition, based on the weight of the particular smokable material. Furthermore, the coated tobacco cut filler may be combined with aerosol forming materials, and employed in the manufacture of those smoking articles described in U.S. Pat. No. 4,708,151 to Shelar; U.S. Pat. No. 4,771,795 to White et al.; U.S. Pat. No. 4,714,082 to Banerjee et al.; U.S. Pat. No. 4,756,318 to Clearman et al.; and U.S. Pat. No. 4,793,365 to Sensabaugh et al., the disclosures of which are incorporated herein by reference, as well as European Patent Publication Nos. 212,234 and 277,519. In addition, the coated tobacco cut filler can be incorporated into those smoking articles described in U.S. Pat. No. 5,074,321 to Gentry et al. and European Patent Publication No. 280,990.

When the tobacco rod is burned during use of the smoking article, the flavorful and aromatic composition exhibits an aroma which can be characterized as pleasant, clean, sweet, floral, woody, musk-like and fruity. The aroma provided by the composition is such that the characteristic sidestream cigarette smoke aroma is masked or overridden by those components. As such the flavorful and aromatic composition provides for a reduction in the negative attributes associated with the aroma of mainstream smoke.

The following example is provided in order to further illustrate preferred aspects of the invention but should not be construed as limiting the scope thereof. Unless otherwise noted, all parts and percentages are by weight.

EXAMPLE I 3.42 pounds of high fructose corn syrup (HFCS), 0.78 pounds of cocoa powder, 0.69 pounds of licorice powder, 0.45 pounds of DAP, 0.19 pounds of L-threonine, 0.19 pounds of L-Leucine and 7.28 pounds of water were placed in a 2-gallon sealed reactor. The resultant aqueous solution was stirred and heated from room temperature to 350° F. over ten (10) minutes. The mixture was stirred for an additional thirty (30) minutes at 350° F. The mixture was thereafter cooled to 140° F. over a period of twenty-six (26) minutes and was discharged from the reactor. The pressure inside the reactor reached 480 psig at the end of the hold period. The resultant product was recovered and labeled as "Casing with Thr and Leu."

As a control experiment, 3.75 pounds of HFCS, 0.85 pounds of cocoa powder, 0.75 pounds of licorice powder, 0.50 pounds of DAP and 7.15 pounds of water were combined and heated under the same regiment. The resultant product was recovered and labeled as "Casing without Amino Acids."

Both cooked casings were analyzed for headspace volatiles and amino sugars. A sample of the headspace was collected from each of the resulting products and analyzed by dynamic headspace Purge and Trap/Gas Chromatography/Mass Selective Detection/Flame Ionization Detection (P&T/GC/MSD/FID) analyses using a conventional Headspace Unit, TEKMAR (Cincinnati, Ohio, USA) LSC 2000 equipped with a TEKMAR 2016 heated sampling station. The headspace sample was obtained and collected over a period of 20 minutes at a temperature of 70° C. from a 0.2 g sample held in a 25 ml sample tube that was swept with dry helium at a flow rate of 40 ml/min and a pressure of 20 psig throughout the sampling period. Then the headspace sample was analyzed by Gas Chromatography/Mass Selective Detection/Flame Ionization Detection as noted above. The general description of the Headspace analysis can be found in W. Coleman et al. *J. Chrom. Sci.* 32:323 (1994). For Casing without Amino Acids, the amount of total pyrazines was found to be 50 $\mu$g per g internal standard. (Cyclohexanone was used as internal standard). For Casing with Thr and Leu, the amount of total pyrazines was 190 $\mu$g per g internal standard, indicating approximately a 4-fold increase in the yield of pyrazines. Sugar thermal degradation products as estimated by furfural and 5-methylfurfural totaled 320 $\mu$g per g internal standard for Casing without Amino Acids, whereas only 180 $\mu$g per g internal standard of furfurals were observed in Casing with Thr and Leu. These results are shown graphically in the FIGURE. Total amino sugars, as measured by mannosamine, galactosamine and glucosamine were 8 $\mu$g/ml for the Casing without Amino Acids and 14 $\mu$g/ml for Casing with Thr and Leu. These results are shown graphically in FIG. 1. Total amino sugars, as measured by mannosamine, galactosamine and glucosamine were 8 $\mu$g/ml for the Casing without Amino Acids and 14 $\mu$g/ml for Casing with Thr and Leu.

The cooked casings were applied to reconstituted tobacco sheet at an application rate of 4 pounds per 1000 pounds of tobacco. Cigarette rods were prepared from the reconstituted tobaccos. Panelists who smoked the cigarettes reported significant perceptual differences in the cooked casing products when compared to a control.

EXAMPLE II

Experiments similar to those of Example I were also performed with individual amino acid asparagine, serine, threonine, leucine, isolecine, and valine respectively in lieu of the combination of the two amino acids threonine and leucine used in Example I. 0.19 pound of one of the above amino acids is used in each experiment. In addition, the same control experiment as described in Example I was also performed (Casing without Amino Acids).

All casings were evaluated for pyrazines. The pyrazines were identified using Autospme GC-mass spectrometry, a method similar to headspace (see "Autospme-chiral-GC-MSD Analysis of Essential Oils" by Coleman, Perfetti and Lawrence, J. Chrom.Sci. Vol. 36, December 1998). Typical pyrazines observed in these casing are reported in Table II. For Casing without Amino Acids and the casing with asparagine, small-chain, volatile pyrazines were observed. However, for the casing with serine, threonine, leucine, isoleucine, or valine, many more pyrazine species were observed and many of them were highly substituted. These highly substituted pyrazines generally exhibit low volatility and high flavor potency.

TABLE II

AUTOSPME RESULTS FOR SPECIFIC PYRAZINES IN SELECTED HEATED CASING FORMULATIONS

| PYRAZINE TYPE DETECTED VIA AUTOSPME/GC/HSD | BASE + DAP | BASE + DAP + ASN | BASE + DAP + SER | BASE + DAP + THR | BASE + DAP + LEU | BASE + DAP + ILE | BASE + DAP + VAL |
|---|---|---|---|---|---|---|---|
| PYRAZINE | x | x | x | | x | | |
| METHYL | x | x | x | x | x | x | x |
| 2,5-DIMETHYL | x | x | x | x | x | x | x |
| 2,6-DIMETHYL | x | x | x | x | x | x | x |
| ETHYL | | | x | x | x | x | x |
| 2,3-DIMETHYL | x | | x | x | x | x | x |
| 2-ETHYL-6-METHYL | x | x | x | x | x | x | x |

TABLE II-continued

AUTOSPME RESULTS FOR SPECIFIC PYRAZINES IN SELECTED HEATED CASING FORMULATIONS

| PYRAZINE TYPE DETECTED VIA AUTOSPME/GC/HSD | BASE + DAP | BASE + DAP + ASN | BASE + DAP + SER | BASE + DAP + THR | BASE + DAP + LEU | BASE + DAP + ILE | BASE + DAP + VAL |
|---|---|---|---|---|---|---|---|
| 2-ETHYL-5-METHYL | x | x | x | x | x | x | x |
| TRIMETHYL | x | x | x | x | x | x | x |
| VINYL | x | x | x | x | | | |
| PROPYL | | | x | x | | | |
| 2-METHYL-5(1-METHYLETHYL) | | | | | x | | |
| 2-METHYLPROPYL | | | x | x | | | |
| 2,6-DIETHYL | | | x | x | x | x | x |
| 3-ETHYL-2,5-DIMETHYL | | x | x | x | x | x | x |
| 2-ETHYL-3,5-DIMETHYL | | x | | | | x | |
| 2,5-DIETHYL | | | | | x | x | x |
| 2,3-DIETHYL | | | x | x | | | |
| 2,3-DIMETHYL-5-ETHYL | | | | | x | | |
| 2-ETHYL-3,5-DIMETHYL | | | x | x | | | |
| 2-VINYL-6-METHYL | x | x | x | x | | | |
| 2-VINYL-5-METHYL | | | | x | x | x | |
| 2,3,5-TRIMETHYL-6-ETHYL | | | | | x | | |
| 2,6-DIMETHYL-3-VINYL (TENT) | | | | | x | | |
| 2-METHYL-6-PROPYL | | | x | x | | | |
| 2-METHYL-3-PROPYL | | | | x | | | |
| 2 METHYL-3-(2-METHYLPROPYL) ISOMERS | | | | | | | x |
| TETRAMETHYL | | | x | | x | | x |
| 2-ETHENYL-6-METHYL+3,5-DIETHYL-2-METHYL | | | x | | x | x | x |
| 2,3-DIETHYL-5-METHYL+2,3-DIETHYL-6-METHYL | | | x | x | | | x |
| 2,5-DIMETHYL-3-(2-METHYLPROPYL) ISOMERS | | | | | | x | x |
| 3,5,6,-TRIMETHYL-2-(2-METHYLPROPYL) ISOMERS | | | | | | | x |
| 2,3-DIMETHYL-3-PROPYL | | | | x | | x | |
| 2,3-DIMETHYL-5-PROPYL | | | | x | | | |
| 2,6-DIMETHYL-6-PROPYL | | | | | | | |
| 2-METHYL-3-(1-PROPENYL) TENT | | | x | x | | | |
| 2-(2-METHYLBUTYL) | | | | | | x | |
| 2-(3-METHYLBUTYL) | | | | | x | | |
| 2-METHYL-3-(2-METHYLBUTYL) ISOMERS | | | | | | x | |
| 2-METHYL-3-(3-METHYLBUTYL) ISOMERS | | | | | x | | |
| 2-METHYL-6-(1-PROPENYL) TENT | | | x | x | | | |
| 2,5-DIMETHYL-3-(2-METHYLBUTYL) ISOMERS | | | | | | x | |
| 2,5-DIMETHYL-3-(3-METHYLBUTYL) ISOMERS | | | | | x | | |
| 2,5-DIMETHYL-6,7-DIHYDRO-5H-CYCLOPENTA | | | | | x | x | |
| METHYLCYCLOPENTA | | | x | x | | x | x |
| DIMETHYL-CYCLOPENTA | | | | x | | | |

TABLE II-continued

AUTOSPME RESULTS FOR SPECIFIC PYRAZINES IN SELECTED HEATED CASING FORMULATIONS

| PYRAZINE TYPE DETECTED VIA AUTOSPME/GC/HSD | BASE + DAP | BASE + DAP + ASN | BASE + DAP + SER | BASE + DAP + THR | BASE + DAP + LEU | BASE + DAP + ILE | BASE + DAP + VAL |
|---|---|---|---|---|---|---|---|
| 2,3,5-TRIMETHYL-6-(3-METHYLBUTYL) | | | | | x | | |
| 2,5,6-TRIMETHYL-3-(2-METHYLPROPYL) ISOMERS | | | | | | x | |
| CYCLOPENTA | | | | | | | |
| 2,5,6-TRIMETHYL-3-(2-METHYLBUTYL) ISOMERS | | | | | | | |
| 2,5,6-TRIMETHYL-3-3-METHYLBUTYL) ISOMERS | | | | | | | |
| 2,5-DIMETHYL-3-PROPENYL | | | x | x | | | |
| METHYLCYCLOHEXA | | | x | x | x | | x |
| DIMETHYLCYLOHEXA | | | x | x | x | | x |

Although the foregoing invention has been described in some detail by way of illustration and example for purposes of clarity of understanding, it will be obvious that certain changes and modifications may be practiced within the scope of the appended claims.

All publications and patent applications mentioned in the specification are indicative of the level of those skilled in the art to which this invention pertains. All publications and patent applications are herein incorporated by reference to the same extent as if each individual publication or patent application was specifically and individually indicated to be incorporated by reference.

That which is claimed:

1. A method for providing flavorful and aromatic substances for use in a smokable material, a smoking article filter, a smoking article wrapper or smoking article packaging, comprising the steps of:

providing a mixture including a reducing sugar source and a base catalyst, said mixture having a selectively enriched content of at least one free amino acid selected from the group consisting of serine, threonine, valine, leucine, and isoluecine;

subjecting said mixture to heat treatment for a time and under conditions sufficient to provide a flavorful and aromatic composition; and applying the flavorful and aromatic composition to smokable material, a smoking article filter, a smoking article wrapper or smoking article packaging.

2. The method of claim 1, wherein said applying step comprises applying the flavorful and aromatic composition to a smokable material, wherein the smokable material is tobacco.

3. The method of claim 2, wherein the smokable material is tobacco laminae or cut filler.

4. The method of claim 2, wherein the flavorful and aromatic composition is applied in an amount of up to about 5% by dry weight based on the dry weight of the smokable material.

5. The method of claim 1, wherein said applying step comprises applying the flavorful and aromatic composition to a smokable material in the form of a top dressing or casing.

6. The method of claim 5, wherein the smokable material is tobacco laminae or cut filler.

7. The method of claim 1, wherein said applying step comprises applying the flavorful and aromatic composition to a smoking article filter in an amount of at least about 0.1% by weight based on the weight of the smoking article filter.

8. The method of claim 1, wherein said reducing sugar source comprises a reducing sugar selected from the group consisting of glucose, fructose, xylose, mannose, galactose, rhamnose, and mixture thereof.

9. The method of claim 1, wherein said reducing sugar source is high fructose corn syrup.

10. The method of claim 1, wherein said base catalyst is selected from the group consisting of ammonium hydroxide, ammonium orthophosphate, ammonium dihydrogen orthophosphate, diammonium phosphate, ammonium citrate, ammounium carbonate, and ammonium acetate.

11. The method of claim 1, wherein said base catalyst is diammonium phosphate.

12. The method of claim 1, wherein said base catalyst is ammonium hydroxide or ammonium carbonate.

13. The method of claim 1, wherein said mixture further comprises licorice.

14. The method of claim 1, wherein said mixture further comprises cocoa.

15. The method of claim 1, wherein said mixture comprises a selectively enriched content of leucine.

16. The method of claim 1, wherein said mixture comprises a selectively enriched content of threonine.

17. The method of claim 1, wherein said mixture comprises a selectively enriched content of leucine and threonine.

18. The method of claim 1, wherein said mixture contains cumulatively from about 1% to about 10% by weight of exogenous amino acids selected from the group consisting of serine, threonine, valine, leucine, and isolecuine based on the total weight of the mixture.

19. The method of claim 1, wherein said mixture contains cumulatively from about 4% by weight of exogenous amino acids selected from the group consisting of serine, threonine, valine, leucine, and isolecuine based on the total weight of the mixture.

20. The method of claim 1, wherein said step of heat treatment is conducted at a temperature of from about 175° F. to about 350° F.

21. The method of claim 1, wherein said step of heat treatment is at a pressure of about 10 psig to about 1000 psig.

22. The method of claim 1 further comprising dissolving said mixture in water to form an aqueous solution prior to said heat treatment.

23. The method of claim 22, wherein the pH of the aqueous solution is about 7.

24. A method for providing flavorful and aromatic substances for use in a smokable material, a smoking article filter, a smoking article wrapper or smoking article packaging, comprising the steps of:

providing a mixture including a reducing sugar source and a base catalyst, licorice, and cocoa, said mixture having a selectively enriched content of at least one free amino acid selected from the group consisting of serine, threonine, leucine, and isoluecine;

subjecting the mixture to heat treatment at a temperature of from about 175 degrees F. to about 380 degrees F. and at a pressure of about 10 psig to about 1000 psig to provide a flavorful and aromatic composition; and applying the flavorful and aromatic composition to a smokable material, a smoking article filter, a smoking article wrapper or smoking article packaging.

25. The method of claim 24, wherein said applying step comprises applying the flavorful and aromatic composition to a smokable material, wherein the smokable material is tobacco.

26. The method of claim 25, wherein the smokable material is tobacco laminae or cut filler.

27. The method of claim 25, wherein the flavorful and aromatic composition is applied in an amount of up to about 5% by dry weight based on the dry weight of the smokable material.

28. The method of claim 24, wherein said applying step comprises applying the flavorful and aromatic composition to a smokable material in the form of a top dressing or casing.

29. The method of claim 28, wherein the smoking article is tobacco laminae or cut filler.

30. The method of claim 24, wherein said applying step comprises applying the flavorful and aromatic composition to a smoking article filter in an amount of at least about 0.1% by weight based on the weight of the smoking article filter.

* * * * *